United States Patent [19]

De Marchi et al.

[11] Patent Number: 4,945,659

[45] Date of Patent: Aug. 7, 1990

[54] SKI BOOT HAVING AN INTERCHANGEABLE SOLE PORTION FOR CONTROLLING GLOBAL WEDGING ANGLE OF THE BOOT

[75] Inventors: Jean-Louis De Marchi, Duingt; Michel Mabboux, Seynod, both of France

[73] Assignee: Salonon S.A., Annecy Cedex, France

[21] Appl. No.: 245,272

[22] Filed: Sep. 16, 1988

[30] Foreign Application Priority Data

Sep. 28, 1987 [FR] France ..... 87 13694

[51] Int. Cl.[5] ..... A43B 5/04

[52] U.S. Cl. ..... 36/117; 36/120; 36/132; 128/583

[58] Field of Search ..... 36/117-121, 36/132; 128/583, 584, 585

[56] References Cited

U.S. PATENT DOCUMENTS

| | | | |
|---|---|---|---|
| 3,470,879 | 10/1969 | Meiller | 128/583 |
| 3,747,235 | 7/1973 | Post . | |
| 3,885,329 | 5/1975 | French . | |
| 3,922,800 | 12/1975 | Miller et al. . | |
| 4,074,446 | 2/1978 | Eisenberg | 36/120 |
| 4,078,322 | 3/1978 | Dalebout | 36/121 |
| 4,351,120 | 9/1982 | Dalebout | 36/117 |
| 4,546,558 | 10/1985 | Perini | 36/120 |

FOREIGN PATENT DOCUMENTS

| | | | |
|---|---|---|---|
| 0171384 | 2/1986 | European Pat. Off. | 36/117 |
| 2127632 | 10/1972 | France . | |
| 2166677 | 8/1973 | France . | |
| 2509586 | 1/1983 | France . | |

*Primary Examiner*—James Kee Chi

*Attorney, Agent, or Firm*—Sandler & Greenblum

[57] ABSTRACT

A ski boot for use with a ski having a top surface includes a rigid shell base having an upper wedged thereon at an orientation angle alpha with respect to the normal to a mating surface carried by a tenon on the toe end of the base. A separate sole portion is provided having a recess complementary to the tenon for slidably receiving the same. The recess of the portion is wedged on a ski at an orientation angle beta with respect to the top surface of the ski when the shell base is connected to the ski by a binding. The global wedging angle of the boot is the algebraic sum of the orientation angle alpha and the wedging angle beta.

29 Claims, 3 Drawing Sheets

2/3

SKI BOOT HAVING AN INTERCHANGEABLE SOLE PORTION FOR CONTROLLING GLOBAL WEDGING ANGLE OF THE BOOT

BACKGROUND OF THE INVENTION

1. Field of Invention

This invention relates to a ski boot having a rigid plastic shell base, and an interchangeable sole portion for controlling the global wedging angle of the boot. In particular, the invention relates to ski boots having soles suitable both for walking and for attachment to ski bindings, and designed to meet certain criteria of international standards selected to assure safe operation of a binding which constitutes the functional interface between a boot and a ski.

2. Discussion of Background Material

The number of skiers engaged in alpine skiing has recently increased; and this increase has aggravated the problem of accommodating ski boots to the morphology of the legs of a certain class of such skiers such that the boots can be used with a maximum of comfort and safety.

The proper global wedging angle of a boot, which is the angle between a plane perpendicular to the top surface of a ski and the direction imposed on the lower leg of the wearer by the upper of the boot, should depend upon the morphological orientation of the leg of a skier. Effecting modification of the global wedging angle to accommodate different skiers is a problem addressed by mechanisms disclosed in U.S. Pat. Nos. 3,922,800, 3,747,235, and 3,885,329; and in French Patent No. 2,166,677. These patents relate to means for orienting the foot of a skier by modifying the orientation of the upper of the boot with respect to the top surface of the ski. Other publications teach adding shims to the sole of a boot to effect a predetermined angular wedging of the upper.

U.S. Pat. No. 4,078,322 discloses a ski boot having removable and interchangeable sole portions. This expedient makes it possible to utilize different wedging angles for a given shell base of a ski boot which is designed for use with conventional bindings by reason of the provision of different sets of sole portions. In this patent, modification of the wedging angle of the boot is achieved only because of the interchangeability of sole portions selected from a stock thereof having angles of inclination lying within a predetermined range. Unfortunately, knowledge of the desired angle of inclination is not always immediately available to a skier. On the other hand, if a skier decides to interchange the sole portion from his right boot with the sole portion from his left boot, the angular wedging is automatically changed from an orientation towards the exterior of his knees to an orientation towards the interior thereof, or vice versa. This does not resolve the problem of morphological adaptation which may become even further aggravated by this exchange.

It is therefore an object of the present invention to improve the angular wedging system of a ski boot having removable sole portions by allowing for the interchangeability of the sole portions of the right boot with the left boot of a single pair of boots such that the amount of angular wedging varies on the interior of a given morphological orientation of the legs of a skier.

SUMMARY OF INVENTION

The present invention is directed to a ski boot for use with a ski having a top surface, wherein the boot is composed of a rigid shell base having an upper attached thereto, and having front and rear ends for establishing interior and exterior directions relative to the leg of a person wearing the boot, and retention means on one of the ends. The upper of the boot is wedged on the base at an orientation angle alpha with respect to the retention means. The boot also includes a sole portion having cooperation means cooperable with the retention means for releasably mounting the sole portion on the shell base, wherein the sole portion is constructed and arranged so that the cooperation means is adapted to be wedged on the ski at a wedging angle beta with respect to the top surface of the ski when the sole portion is connected to the ski by a binding. The retention means is preferably in the form of a tenon carrying a planar mating surface, and the cooperation means is in the form of recess complementary to the tenon for slidably receiving said tenon.

The ski boot in accordance with the present invention, as described above, may include a second retention means on the other of the ends of the shell having a second mating surface, wherein the upper is wedged on the base at an orientation angle alpha with respect to the second mating surface; the boot may also include a second sole portion having second cooperation means cooperable with the second mating surface for releasably mounting the second sole portion on the shell base.

Preferably, the retention means is in the form of a tenon carrying the mating surface thereon, and each cooperation means is in the form of a recess complementary to and slidably receiving a tenon, in which case the orientation angle alpha preferably extends in the exterior direction, and the orientation angle alpha is different from said wedging angle beta.

The ski boot in accordance with the present invention, as described above, preferably includes a sole portion having a bottom surface for contacting the top surface of the ski when the shell base is connected to the ski by a binding, and indicia means are provided in the bottom surface for indicating the magnitude and direction of the wedging of the boot.

The ski boot of the present invention, may also include means for releasably attaching the sole portion to the shell base to prevent inadvertent detachment of the sole portion.

The orientation angle alpha of the ski boot in accordance with the present invention, as described above, may extend in the exterior direction as well as in the interior direction; and the orientation angle alpha may be different from the wedging angle beta.

In addition, the present invention is also directed to a pair of ski boots for use with skis each of which has a top surface, wherein the pair of ski boots includes a left and a right rigid shell base each having an upper wedged thereon at an orientation angle alpha with respect to a mating surface carried by a tenon on the toe end of the base; and a sole portion associated with each base and having a recess complementary to the tenon on the base for slidably receiving the same and releasably mounting the sole portion on the base; wherein the recess of a sole portion is wedged on a ski at an orientation angle beta with respect to the top surface thereof when the shell base with which the sole portion is associated is connected to the ski by a binding; and the sole portions are constructed and arranged so as to be interchangeable between the left and the right boots, preferably wherein the wedging angle beta of the sole portions are of equal magnitude but of opposite sign.

Also, the present invention is directed to a sole portion for a ski boot for use with a ski having a top surface, wherein the boot has a rigid shell base and an upper wedged thereon at an orientation angle alpha with respect to the normal to a mating surface carried by tenon on one end of said base. The sole portion includes cooperation means in the form of a recess complementary to the tenon for slidably receiving the same and mounting the sole portion on the shell base of the boot such that the recess is wedged on the ski at an orientation angle beta with respect to the top surface of the ski when the shell base is connected thereto by a binding, wherein the cooperation means is constructed and arranged such that the orientation angle alpha is different from the wedging angle beta. The sole portion may also include a bottom surface for contacting the top surface of the ski when the shell base is connected thereto by a binding, wherein the bottom surface including surface gripping means, as well as indicia on the bottom surface for indicating the magnitude and direction of the global wedging angle of the boot to which the portion is attached.

An alpine ski boot according to the present invention, as described above, is designed to receive a removable portion on the sole of the boot, such portion being in the form of a unitary member that extends the entire length of the sole of the boot, or preferably, in the form of separate tip portions, one for the toe of the boot and one for the heel. These portions serve to wedge the upper of the boot on a ski to which the boot is attached at a designated global wedging angle with respect to the top of the ski or to the plane of contact of the ski with the ground. Each portion may be provided with a cavity or opening of appropriate shape constituting cooperation means that cooperate with retention means of complementary shape provided on the shell base of the boot.

A ski boot according to the present invention is thus used with a ski having a top surface, the boot including a rigid shell base having an upper attached thereto and having front and rear ends for establishing interior and exterior directions relative to the leg of a person wearing the boot. Retention means are provided on at least one of the ends of the shell base; and the upper is wedged on the base at an orientation angle alpha with respect to the retention means. A sole portion is provided having cooperation means cooperable with the retention means for releasably mounting the sole portion on the shell base. The cooperable means are adapted to be wedged on the ski at a wedging angle beta with respect to the top surface of the ski when the shell base is connected thereto by a binding. As a consequence of this construction, the global wedging angle is the algebraic sum of the orientation angle alpha and the wedging angle beta. Preferably, the orientation angle alpha is different from the wedging angle beta.

In the preferred form of the invention, the retention means is in the form of a tenon carrying a planar mating surface, and the cooperation means is in the form of a recess complementary to the tenon for slidably receiving the same.

The sole portion for the left boot is interchangeable with the sole portion of the right boot. Under this circumstance, the magnitude of the wedging angles beta of the sole portions are the same, but the sign of the wedging angles are opposite.

BRIEF DESCRIPTION OF DRAWINGS

Non-limiting embodiments of the present invention are shown in the accompanying drawings wherein.

DESCRIPTION OF PREFERRED EMBODIMENTS

Figure 1:
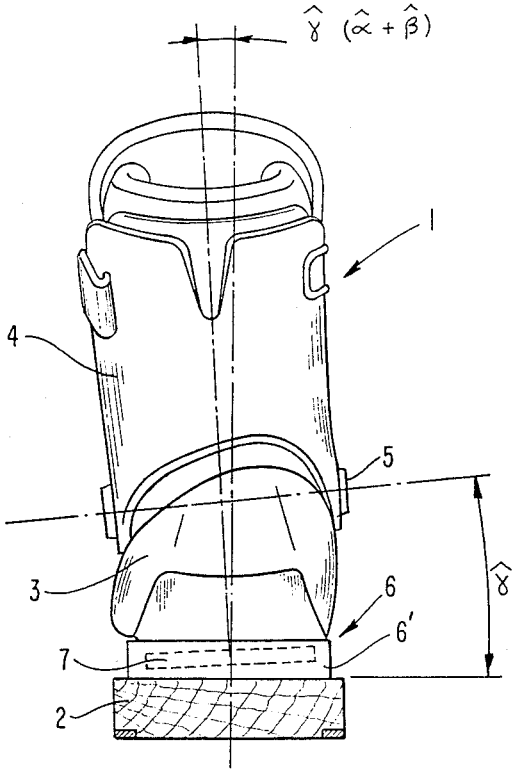
FIG. 1 is a front view of a boot mounted on a ski by means of a toe sole portion constructed according to the present invention, the boot including an upper pivotally mounted on a rigid shell base.

Referring now to FIG. 1, reference numeral 1 designates a ski boot according to the present invention positioned on the upper of ski 2 which serves as a reference surface for defining the global wedging angle of the boot. Boot 1 is constituted by rigid shell 3 having upper 4 journalled for pivotal movement on axis 5, and having sole 6 adapted both for walking and for cooperation with binding means (not shown) for securing the boot to ski 2. The global wedging angle gamma of the boot is the angle that axis 5 makes with the top surface of ski 2 when the boot is attached by a binding to the top of a ski.

Sole 6 of the boot includes a removable portion which may comprise separate tip portion 6' on the front or toe end of the boot, and tip portion 6'' on the back or heel end of the boot. Portions 6' and 6'' are attached to the lower part of the shell by cooperation means on each portion cooperable with retention means integral with the boot for locating and retaining the portions to the shell base. If necessary, additional assembly means such as screws, rivets, etc. can be used to enhance retention of the portions on the base.

Figure 2:
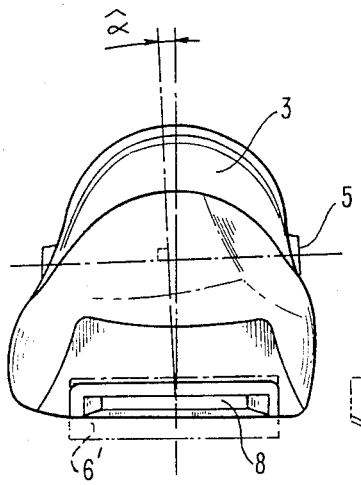
FIGS. 2 and 3 are front and side views, respectively, of a rigid shell base of a boot illustrating retention means in the form of extensions on the shell base, these extensions having an orientation angle alpha with respect to the pivot axis of the upper on the base.
Figure 3:
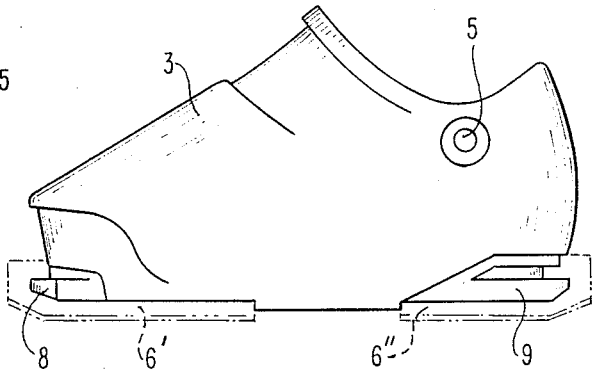

Rigid shell 3 is provided on its lower portion, as shown in FIGS. 2 and 3, with retention means adapted to receive cooperation means 7 provided on the portions. These retention means are constituted at the front and at the heel of the shell base, respectively, by tenons 8 and 9 which project forwardly and rearwardly respectively from the base and slideable receive corresponding portions 6′ at the toe and 6″ at the heel (as shown in the dashed lines) according to one of the characteristic features of the invention. As a consequence, the upper of shell base 3 is wedged at an orientation angle alpha with respect to the normal to the plane containing the lower mating surface of tenons 8, 9 such that axis 5, about which the upper is pivotal on the base, is inclined at an angle alpha with respect to the top surface of the ski. This angle is directed toward the exterior for both a right boot illustrated in FIG. 2, and a left boot as well. Thus, journalled upper 4 is mounted on the shell so as to be pre-wedged or inclined towards the exterior by the predetermined angle alpha. According to a preferred embodiment, the orientation angle alpha is on the order of about 2°30′, and is directed towards the exterior for each of a single pair of boots. As explained below, this orientation angle can be reversed if necessary.

Figure 4A:
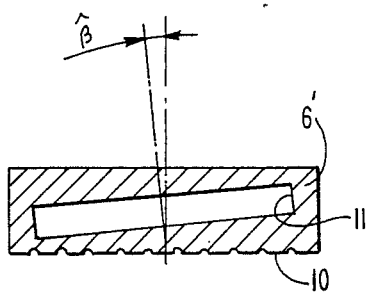
FIGS. 4*a* and 4*b* show cooperation means of a pair of left and right sole portions each of which has a cavity defining a mating surface which establishes a wedging angle beta with respect to the plane of the contact surface with the ground or with the top of a ski.
Figure 4B:
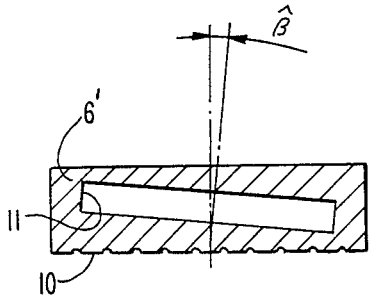

FIG. 4 illustrates a pair of opposite handed tip portions 6′, wherein the portion for a left boot is shown in FIG. 4*a*, and the portion for a right boot is shown in FIG. 4*b*. Each portion 6′ comprises ground engaging surface 10 provided, at least partially, with an anti-ski relief pattern in the form of surface gripping means. Contained within the thickness of the portion is cavity 11 whose shape and dimensions correspond and are complementary to those of those of tenons 8 and 9. Cavity 11 and tenons 8 and 9 in each portion are preferably, but not necessarily, rectilinear, and inclined with respect to the normal to the top surface of a ski when the boot associated with the portion is attached to the ski by a binding. The inclination of cavity 11 defines angle beta which is oriented, for example, towards the exterior of the boot.

Figure 5A:
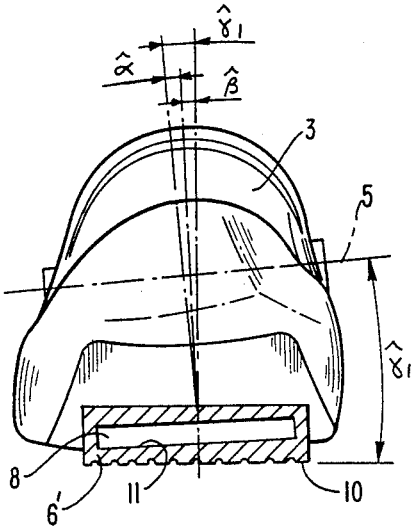
FIGS. 5*a* and 5*b* show a pair of left and right shells of a pair of ski boots according to the present invention whose global wedging angle gamma is the result of mounting sole portions having oppositely directed wedging angles beta on a shell base having an orientation angle alpha.
Figure 5B:
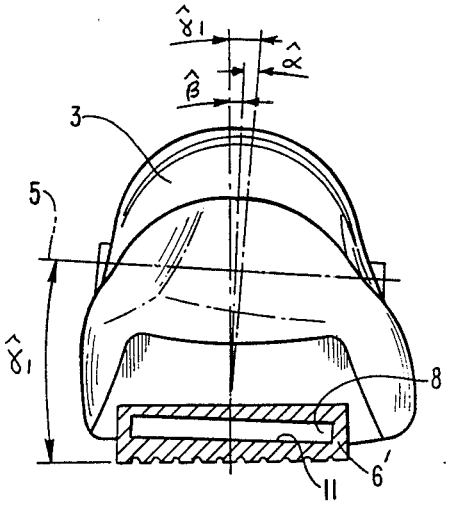
Figure 6A:
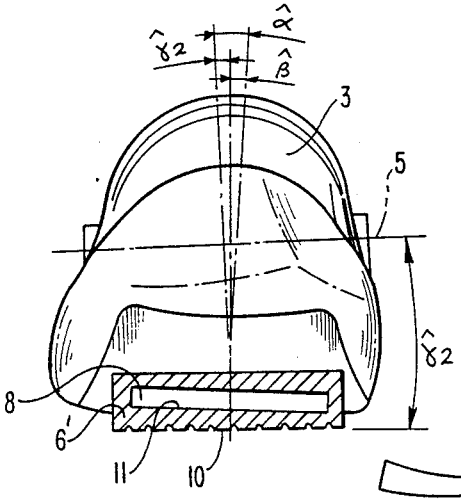
FIGS. 6*a* and 6*b* show a pair of ski boot shells according to the present invention showing the effect on the global wedging angle gamma due to reversing the mounting of the sole portions shown in FIGS. 5*a* and 5*b* so that the right sole portion is mounted on the left shell, and the left sole portion is mounted on the right shell.
Figure 6B:
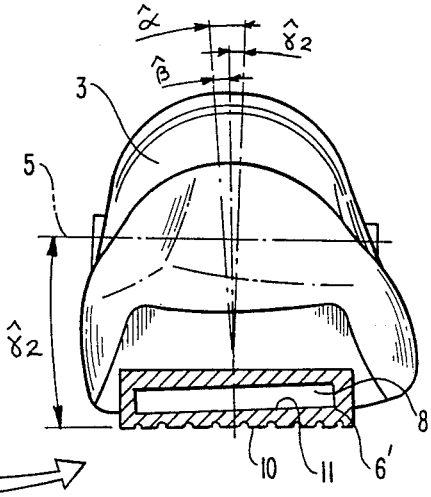

FIG. 5 illustrates an application of the present invention to a pair of shells of ski boots provided with removable tip portions showing the effect of the orientation angle alpha associated with the boot alone) and the wedging angle beta (associated with the tip portions alone) on the global wedging angle. This global wedging angle gamma is obtained by the combination of rigid shell 3, whose orientation angle alpha is preoriented towards the exterior, with sole tip portions 6′, 6″ each having its cavity 11 establishing a wedging angle beta. By way of example, the mounting of shell 3 of a boot is achieved by employing tenon 8 which nests in cavity 11 in tip portion 6′. Each of the elements thus mounted and assembled establish the angles alpha and beta, the value of the global wedging angle gamma being the algebraic sum of the angles alpha and beta. A shell may have, for example, an orientation angle alpha of 2°30 with respect to the plane of the mating surfaces of its retention means constituted by tenons 8 and 9. Cavities 11 in the tip portions, which constitute cooperation means for cooperating with the tenons, may have a wedging angle beta that ranges from about 0°30′ to 1°30′. For a single pair of boots, tip portions having wedging angles of opposite hand can be used on each boot in symmetrical fashion as shown in FIGS. 5*a* and 5*b*; or, the wedging angles beta of the tip portions can be different. Depending upon the circumstances, the angle beta may be less than the angle alpha. However, the global wedging angle gamma will always be directed towards the exterior of the wearer even after switching the right tip to the left boot and the left tip to the right boot (FIGS. 6*a* and 6*b*).

The range of adjustment of the lateral inclination of the boots of a single pair is shown in the following table and defined by the limits gamma 1 and gamma 2:

| | alpha | DIRECTION | beta | DIRECTION | gamma | DIRECTION |
|---|---|---|---|---|---|---|
| FIG. 5 | 2°30′ | exterior | 0°30′ | exterior | 3° | exterior |
| FIG. 6 | | exterior | 0°30′ | interior | 2° | exterior |
| FIG. 5 | 2°30′ | exterior | 1°30′ | exterior | 4° | exterior |
| FIG. 6 | | exterior | 1°30′ | interior | 1° | exterior |

The arrangement according to the invention permits a bowlegged skier whose legs are curved towards the exterior to adjust the value of wedging of his boots by judicious selection of suitable tip portions and appropriate application to the boots. Similarly, the same arrangements can be made for knock-kneed skiers whose legs are curved towards the interior, either by preserving the angle of orientation alpha by a lateral inclination towards the exterior of the boot but using tip portions whose wedging angle beta tips are greater than alpha. Alternatively, the orientation angle alpha can be selected to provide an inclination towards the interior of the boot; and tip portions can be selected to provide wedging angles beta less than alpha.

Figure 7:
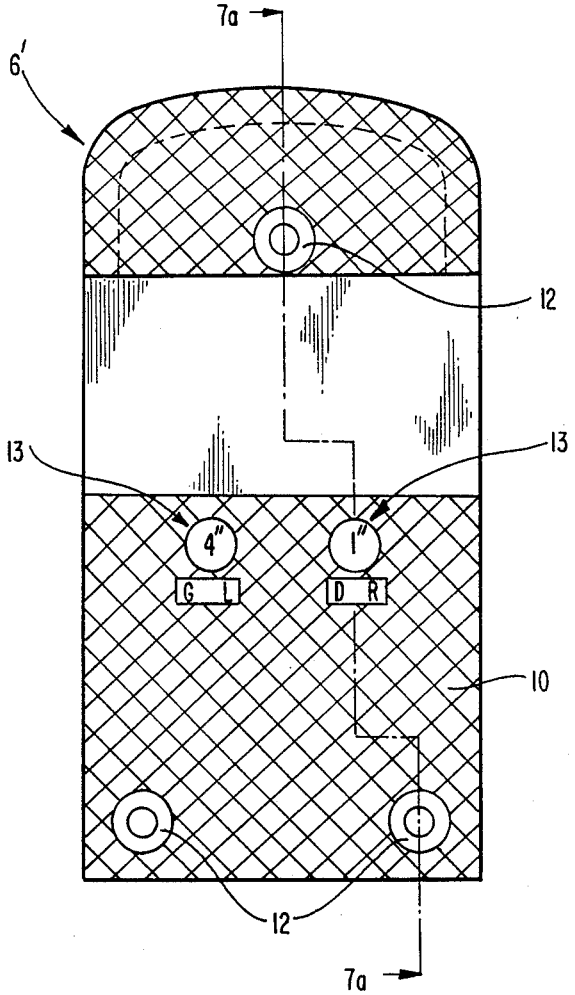
FIGS. 7 and 7*a* are bottom and cross-section views, respectively, of an alternative form of a sole portion provided with indicia that shows the global wedging angle gamma that will result depending on whether the portion is employed on a left or a right ski boot.
Figure 7A:
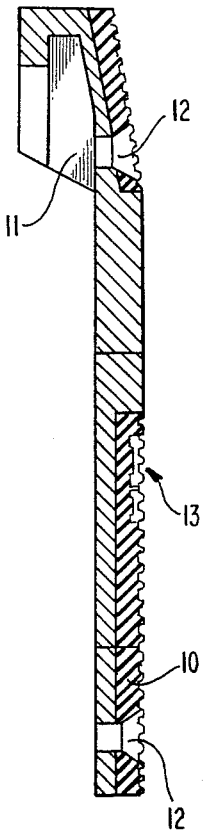

To improve the retention of the tip portions on the tenons of the shell, removable assembly means may be provided where necessary. FIGS. 7 and 7*a* illustrate this in that three screw holes 12 are provided in tip portion 6. Ground engaging surface 10 of portions 6′ include indicia 13 which displays the magnitude and direction of the global wedging angle gamma obtained depending upon whether the tip portion is applied to the left boot or to the right boot. Preferably, the indicia are placed in countersunk recesses or hollows in the anti-slip reliefs on each of the tips such that the visibility of the markings is not affected by wear of the ground-engaging surface.

The different descriptions described above with reference to FIGS. 1–7*a* define various possibilities of attachment and use of the means of the invention, and other embodiments and ways of putting the invention to use exist without going beyond the scope of the invention.

While the above description refers to, and the drawings show, retention means on the shell base in the form of a tenon having a rectilinear cross-section, other shapes are of course possible. In such case, the orientation angle alpha is measured as the angle between the axis about which the upper pivots and the normal to the vertical median plane of the shell.

Finally, although the invention has been described with reference to particular means, materials and embodiments, the invention is not limited to the particulars disclosed and extends to all equivalents within the scope of the claims.

I claim:

1. A ski boot for use with a ski having a top surface, said boot comprising:

(a) a rigid shell base having an upper attached thereto, and having front and rear ends for establishing interior and exterior directions relative to the leg of a person wearing the boot, and retention means on one of said ends, said upper being wedged on the base at an orientation angle alpha with respect to said retention means;

(b) a sole portion having cooperation means cooperable with said retention means for releasably mounting the sole portion on the shell base, said sole portion being constructed and arranged so that said cooperation means is adapted to be wedged on the ski at a wedging angle beta with respect to the top surface of the ski when the sole portion is connected to the ski by a binding.

2. A ski boot according to claim wherein said retention means in the form of a tenon carrying a planar mating surface, and said cooperation means is in the form of recess complementary to said tenon for slidably receiving said tenon.

3. A ski boot according to claim wherein said orientation angle alpha extends in the exterior direction.

4. A ski boot according to claim 1 wherein said orientation angle alpha extends in the interior direction.

5. A ski boot according to claim 2 wherein said orientation angle extends in the exterior direction.

6. A ski boot according to claim 2, wherein said orientation angle alpha extends in the interior direction.

7. A ski boot according to claim 1 wherein said orientation angle alpha is different from the wedging angle beta.

8. A ski boot according to claim 7 wherein said orientation angle alpha extends in the exterior direction.

9. A ski boot according to claim 7 wherein said orientation angle alpha extends in the interior direction.

10. A ski boot according to claim 2 wherein said orientation angle alpha is different from said wedging angle beta.

11. A ski boot according to claim 10 wherein said orientation angle alpha extends in the exterior direction.

12. A ski boot according to claim 10 wherein said orientation angle alpha extends in the interior direction.

13. A ski boot according to claim 1 including a second retention means on the other of said ends of said shell having a second mating surface, said upper being wedged on the base at an orientation angle alpha with respect to the second mating surface, and including a second sole portion having second cooperation means cooperable with said second mating surface for releasably mounting said second sole portion on the shell base.

14. A ski boot according to claim 13 wherein said orientation angle alpha extends in the exterior direction.

15. A ski boot according to claim 14 wherein said orientation angle alpha is different from said wedging angle beta.

16. A ski boot according to claim 13 wherein said orientation angle alpha extends in the interior direction.

17. A ski boot according to claim 16 wherein said orientation angle alpha is different from said wedging angle beta.

18. A ski boot according to claim 13 wherein each retention means is in the form of a tenon carrying the mating surface thereon, and each cooperation means is in the form of a recess complementary to and slidably receiving a tenon.

19. A ski boot according to claim 18 wherein said orientation angle alpha extends in the exterior direction.

20. A ski boot according to claim 19 wherein said orientation angle alpha is different from said wedging angle beta.

21. A ski boot according to claim 1 wherein said sole portion includes a bottom surface for contacting said top surface of the ski when the shell base is connected to the ski by a binding, and indicia means are provided in the bottom surface for indicating the magnitude and direction of the wedging of the boot.

22. A ski boot according to claim 2 wherein said orientation angle alpha extends in the exterior direction.

23. A ski boot according to claim 1 including means for releasably attaching the sole portion to the shell base to prevent inadvertent detachment of the sole portion.

24. A ski boot according to claim 2 including means for releasably attaching the sole portion to the shell base to prevent inadvertent detachment of the sole portion.

25. A pair of ski boots for use with skis each of which has a top surface, said pair comprising:

(a) a left and a right rigid shell base each having an upper wedged thereon at an orientation angle alpha with respect to a mating surface carried by a tenon on the toe end of the base;

(b) a sole portion associated with each base and having a recess complementary to the tenon on the base for slidably receiving the same and releasably mounting the sole portion on the base;

(c) the recess of a sole portion being wedged on a ski at an orientation angle beta with respect to the top surface thereof when the shell base with which the sole portion is associated is connected to the ski by a binding; and (d) the sole portions being constructed and arranged so as to be interchangeable between the left and the right boots.

26. A pair of ski boots according to claim 25 wherein the wedging angle beta of the sole portions are of equal magnitude but of opposite sign.

27. A sole portion for a ski boot for use with a ski having a top surface, said boot having a rigid shell base and an upper wedged thereon at an orientation angle alpha with respect to the normal to a mating surface carried by tenon on one end of said base, said portion comprising:

(a) cooperation means in the form of a recess complementary to said tenon for slidably receiving the same and mounting the sole portion on the shell base of the boot such that the recess is wedged on the ski at an orientation angle beta with respect to the top surface of the ski when the shell base is connected thereto by a binding; and (b) said cooperation means being constructed and arranged such that the orientation angle alpha is different from the wedging angle beta.

28. A sole portion according to claim 27 including a bottom surface for contacting the top surface of the ski when the shell base is connected thereto by a binding, said bottom surface including surface gripping means.

29. A sole portion according to claim 28 including indicia on the bottom surface for indicating the magnitude and direction of the global wedging angle of the boot to which the portion is attached.

* * * * *